US008393096B2

(12) United States Patent
Thomas

(10) Patent No.: US 8,393,096 B2
(45) Date of Patent: Mar. 12, 2013

(54) PLOW FOR USE WITH A MOTORIZED WHEELCHAIR

(76) Inventor: Charles A. Thomas, Tijeras, NM (US)

( * ) Notice: Subject to any disclaimer, the term of this patent is extended or adjusted under 35 U.S.C. 154(b) by 0 days.

(21) Appl. No.: 12/925,111

(22) Filed: Oct. 14, 2010

(65) Prior Publication Data

US 2011/0099857 A1 May 5, 2011

Related U.S. Application Data

(63) Continuation-in-part of application No. 12/380,600, filed on Feb. 27, 2009, now abandoned.

(60) Provisional application No. 61/067,439, filed on Feb. 28, 2008.

(51) Int. Cl.
*E01H 6/00* (2006.01)

(52) U.S. Cl. ..... 37/241; 280/304.1

(58) Field of Classification Search ..... 37/266, 37/263, 265, 284, 285, 241; 172/811, 817; 280/304.1; 294/54.5
See application file for complete search history.

(56) References Cited

U.S. PATENT DOCUMENTS

| | | | | | |
|---|---|---|---|---|---|
| 157,078 | A | * | 11/1874 | Parker | 37/274 |
| 323,656 | A | * | 8/1885 | Franz | 37/274 |
| 659,560 | A | * | 10/1900 | Tietjen | 280/7.12 |
| 731,419 | A | * | 6/1903 | Wykofp | 37/273 |
| 773,959 | A | * | 11/1904 | Meissner | 280/7.12 |
| 956,896 | A | * | 5/1910 | Gross | 37/273 |
| 1,075,154 | A | * | 10/1913 | Mansfield | 37/278 |
| 1,276,672 | A | * | 8/1918 | Mason | 37/273 |
| 1,392,166 | A | * | 9/1921 | Immer | 37/263 |
| 2,061,585 | A | * | 11/1936 | Meyer | 37/233 |
| 2,152,092 | A | * | 3/1939 | Rougier | 37/231 |
| 2,345,460 | A | * | 3/1944 | Coderre | 37/241 |
| 2,432,780 | A | | 12/1947 | Mader | |
| 2,460,560 | A | | 2/1949 | Williams | |
| 2,776,767 | A | * | 1/1957 | Stover | 414/717 |
| 2,811,792 | A | * | 11/1957 | Cork, Jr. | 37/284 |
| 2,816,772 | A | * | 12/1957 | Lapointe | 280/87.01 |
| 2,908,090 | A | * | 10/1959 | Eifel | 37/274 |
| 3,087,266 | A | * | 4/1963 | McEvoy | 37/263 |
| 3,350,797 | A | * | 11/1967 | Dassinger et al. | 37/241 |
| 3,526,979 | A | * | 9/1970 | Ladewski | 37/273 |
| 3,608,216 | A | * | 9/1971 | Prescott | 37/231 |
| 3,664,042 | A | * | 5/1972 | Duran | 37/278 |
| 3,760,516 | A | * | 9/1973 | Billingsley | 37/231 |
| 3,807,065 | A | * | 4/1974 | Billingsley | 37/283 |
| 3,994,081 | A | * | 11/1976 | Middleton | 37/273 |

(Continued)

FOREIGN PATENT DOCUMENTS

| | | | |
|---|---|---|---|
| JP | 2001-294006 | A | 10/2001 |
| JP | 2002052047 | A * | 2/2002 |

OTHER PUBLICATIONS

Wheelchair Diffusion, "Wheelchair Recycler", Jan. 1, 2006 http://www.usatechguide.org/blog/wheelchair-recycler/.*

*Primary Examiner* — Jamie L McGowan
(74) *Attorney, Agent, or Firm* — Rod D. Baker

(57) ABSTRACT

A snowplow and mounting assembly having a mounting frame for use with a motorized wheelchair wherein the mounting frame has one side with a V-shape or other shape snowplow facing away from the wheelchair and has another side that faces the wheelchair and is adapted to cooperate with the wheelchair in use to plow snow. A particular snowplow and mounting assembly has a mounting frame for pressed engagement with the tip wheels of a wheelchair; a snowplow blade disposed on one side of the frame; first and second push wheel brackets disposed on the other side of the frame for contacting the first and second tip wheels of the motorized wheelchair; and at least one handle disposed on the frame adapted to be operated by user of the wheelchair.

5 Claims, 9 Drawing Sheets

U.S. PATENT DOCUMENTS

| | | | | | |
|---|---|---|---|---|---|
| 4,024,653 | A | * | 5/1977 | Morris | 37/231 |
| 4,179,828 | A | * | 12/1979 | Brunty | 37/241 |
| 4,258,485 | A | * | 3/1981 | Gof | 37/283 |
| 4,462,172 | A | * | 7/1984 | Caron | 37/231 |
| 4,470,598 | A | * | 9/1984 | Steele et al. | 473/56 |
| 4,484,755 | A | * | 11/1984 | Houston | 280/33.992 |
| 4,532,725 | A | * | 8/1985 | Trejo et al. | 37/243 |
| 4,776,115 | A | * | 10/1988 | Nicodemus et al. | 37/231 |
| 4,796,367 | A | * | 1/1989 | Kulat | 37/273 |
| 4,873,775 | A | * | 10/1989 | Richey | 37/231 |
| 4,944,104 | A | * | 7/1990 | Kowalczyk | 37/231 |
| 5,048,206 | A | * | 9/1991 | Jones | 37/265 |
| 5,094,019 | A | * | 3/1992 | DeVincenzo | 37/197 |
| 5,096,361 | A | * | 3/1992 | Crawford | 414/462 |
| 5,159,769 | A | | 11/1992 | Odorisio | |
| 5,251,390 | A | * | 10/1993 | Wong | 37/231 |
| 5,427,398 | A | * | 6/1995 | Weybrecht | 280/304.1 |
| 5,441,285 | A | * | 8/1995 | Russell et al. | 280/10 |
| 5,509,219 | A | * | 4/1996 | Mecca | 37/231 |
| 5,511,328 | A | | 4/1996 | Fingerer et al. | |
| 5,581,915 | A | * | 12/1996 | Lobato | 37/285 |
| 5,704,627 | A | * | 1/1998 | Davis et al. | 280/304.1 |
| 5,791,072 | A | * | 8/1998 | Schbot | 37/278 |
| 5,944,131 | A | * | 8/1999 | Schaffner et al. | 180/65.1 |
| 6,129,165 | A | * | 10/2000 | Schaffner et al. | 180/65.1 |
| 6,269,558 | B1 | | 8/2001 | Alexander | |
| 6,474,007 | B1 | * | 11/2002 | Sueshige et al. | 37/266 |
| 6,513,267 | B2 | * | 2/2003 | Yoshida et al. | 37/283 |
| 6,516,544 | B1 | * | 2/2003 | Matisz et al. | 37/231 |
| 6,766,871 | B2 | * | 7/2004 | Sawyer | 180/13 |
| 6,830,114 | B2 | * | 12/2004 | Hammonds | 180/6.2 |
| 6,948,268 | B1 | * | 9/2005 | Ronca | 37/284 |
| 7,111,418 | B2 | * | 9/2006 | Noonan | 37/265 |
| 7,364,170 | B2 | * | 4/2008 | Aittama et al. | 280/33.992 |
| 7,735,847 | B2 | * | 6/2010 | Dougherty | 280/304.1 |
| 2001/0045029 | A1 | * | 11/2001 | Fulton | 37/266 |
| 2005/0081409 | A1 | * | 4/2005 | Scherer | 37/285 |
| 2007/0068050 | A1 | * | 3/2007 | Flanagan | 37/285 |

* cited by examiner

PLOW FOR USE WITH A MOTORIZED WHEELCHAIR

RELATED APPLICATIONS

This application is a continuation-in-part of U.S. patent application Ser. No. 12/380,600 entitled "Snowplow and Mount Assembly for Use with a Wheelchair," filed 27 Feb. 2009, and claims priority thereto and incorporates the disclosure thereof.

FIELD OF THE INVENTION

This invention relates generally to wheelchair attachments and snow removal equipment and, more particularly, to a snowplow and mount assembly for removably securing and use of a snowplow with a wheelchair.

BACKGROUND OF THE INVENTION

Every winter people are left trapped in their homes due to heavy snowfall because they are confined to a wheelchair and do not have friends or family available to shovel their driveways, walkways, and doorways. Especially in the northern parts of the United States, people are forced to remain in their homes for three months (or more) of every year. It is desirable to provide a solution to allow those bound to a wheelchair to easily and independently remove snow from around their homes.

SUMMARY OF THE INVENTION

The present invention provides a snowplow and mounting assembly having a mounting frame for use with a wheelchair wherein the mounting frame has one side with a snowplow facing away from the wheelchair and has another side that faces the wheelchair and is adapted to cooperate with the wheelchair in use to plow snow. An illustrative embodiment of the apparatus provides a snowplow and mounting assembly that comprises a mounting frame for releasable connection to a wheelchair; a snowplow blade disposed on one side of the frame; first and second pivotal linkages disposed on the other side of the frame for releasably engaging first and second wheels of a wheelchair; and at least one handle disposed on the frame adapted to be operated by user of the wheelchair.

In another embodiment, the apparatus comprises a snowplow and mount assembly comprising a mounting frame adapted to be releasably connected to a wheelchair, wherein the mounting frame comprises a front side on which a snowplow blade is disposed and a back side which faces toward and is adjacent to the wheelchair. The mounting frame and snowplow blade can be constructed from metal, plastic, wood or any other material of sufficient strength for plowing snow. The mounting frame includes first and second pivotal linkages disposed on its back side proximate outer peripheral side regions thereof. Further, the mounting frame can include at least one handle attached to the frame which would allow the user to lift the snowplow.

The first and second pivotal linkages include respective pivotal linkage arms that can be connected by the user to the first (left) and second (right) wheels of a wheelchair to releasably secure the snowplow onto a wheelchair while it is in use. To keep the linkage arms in place during use, a locking element can be connected between the pivotal linkages and the mounting frame. The first and second linkage arms are disposed on respective pivot shafts, which are connected to a pivot support, such as a bracket. The pivot support can be connected to the back side of the mounting frame by welding, mechanical fasteners, and the like. Further, the first and second pivotal linkage arms can include a respective pivot-shaft receiving member, which is disposed on and can pivot or rotate on the respective pivot shaft. The pivot motion allows the linkage arms to be releasably engaged to first and second wheels of a wheelchair. The pivotal linkages can comprise a hinge, pivot joint or other pivot mechanism.

In an alternative embodiment of the apparatus, the mount assembly comprises a mounting frame adapted to be pushed by the tip wheels of a wheelchair, wherein the mounting frame comprises a front side on which a snowplow blade is disposed and a back side which faces toward and is adjacent to the wheelchair. The mounting frame includes a pair of wheel push brackets disposed on its back side proximate outer peripheral side regions thereof, which can be pushably engaged by the tip wheels of the wheelchair. The tip wheels push against the brackets, which in turn pushes the plow along the ground. The mounting frame in this embodiment preferably features two small blade wheels, one on each side of the plow.

Further, the mounting frame can include at least one handle attached to the frame which would allow the user to lift the snowplow. The handle can be connected to the mounting frame and can be constructed from metal, plastic, or other material. Because the snowplow and mounting assembly feature small blade wheels, they and the tip wheels allow the user to easily lift and pivot the snowplow up and down during use about the region of tip wheel engagement against the plow.

Finally, the snowplow and mounting assembly can include a bottom edge that is disposed on and forms part of the mounting frame and extends past the front side of the frame. The bottom edge can be at the bottom of the front side of the frame and can extend beyond the front side to include sharpened blades, which can allow the snowplow to cut under the snow for easier removal of snow. Also, when there is no snow, the sharpened blades can be used to slice through weeds or grass. Alternatively, the bottom edge can be serrated or comprise a blade, to permit the plow to be used as a weed-cutter in non-winter-like seasons or climates.

BRIEF DESCRIPTION OF THE DRAWINGS

The accompanying drawings, which are incorporated into and form a part of this specification, illustrate several embodiments of the present invention and, together with the description, serve to explain the principles of the invention. The drawings are only for the purpose of illustrating a preferred embodiment of the invention and are not to be construed as limiting the invention. In the drawings.

Like numbers are used to denote like elements of the apparatus throughout the various views.

DETAILED DESCRIPTION OF A PREFERRED EMBODIMENT OF THE INVENTION

Figure 1:
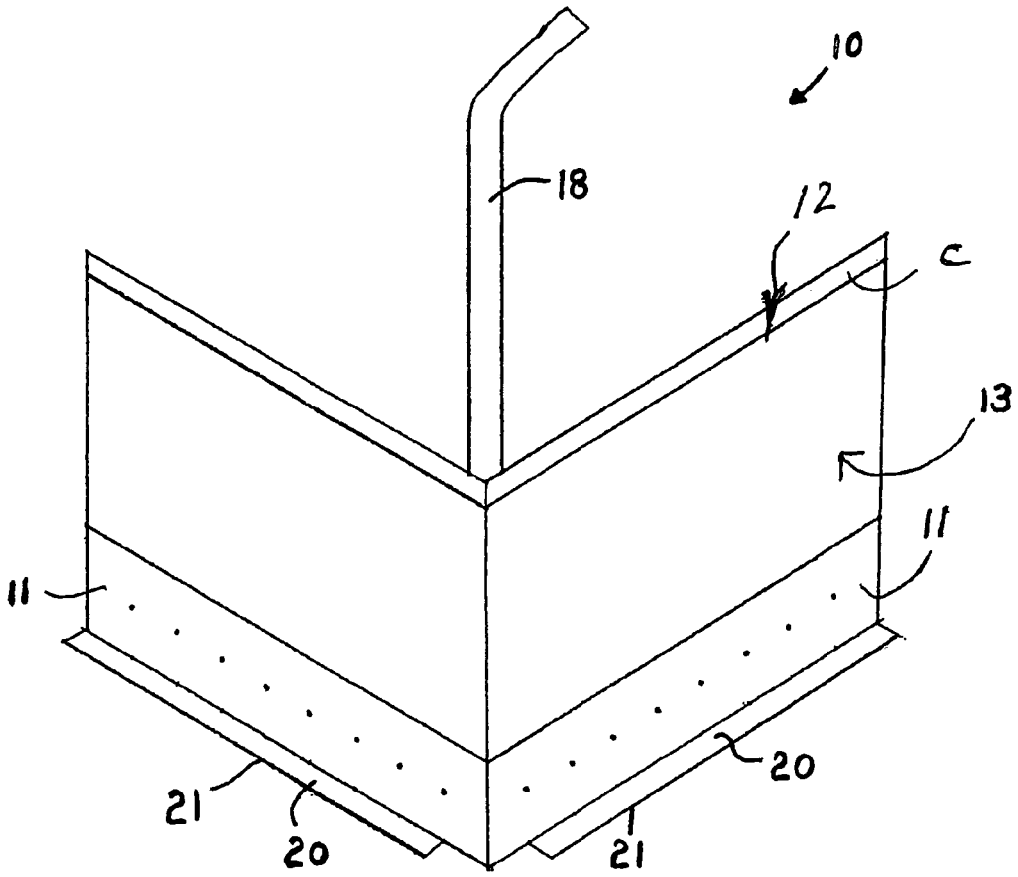
FIG. 1 is a front view of an embodiment of the snowplow and mounting assembly.
Figure 2:
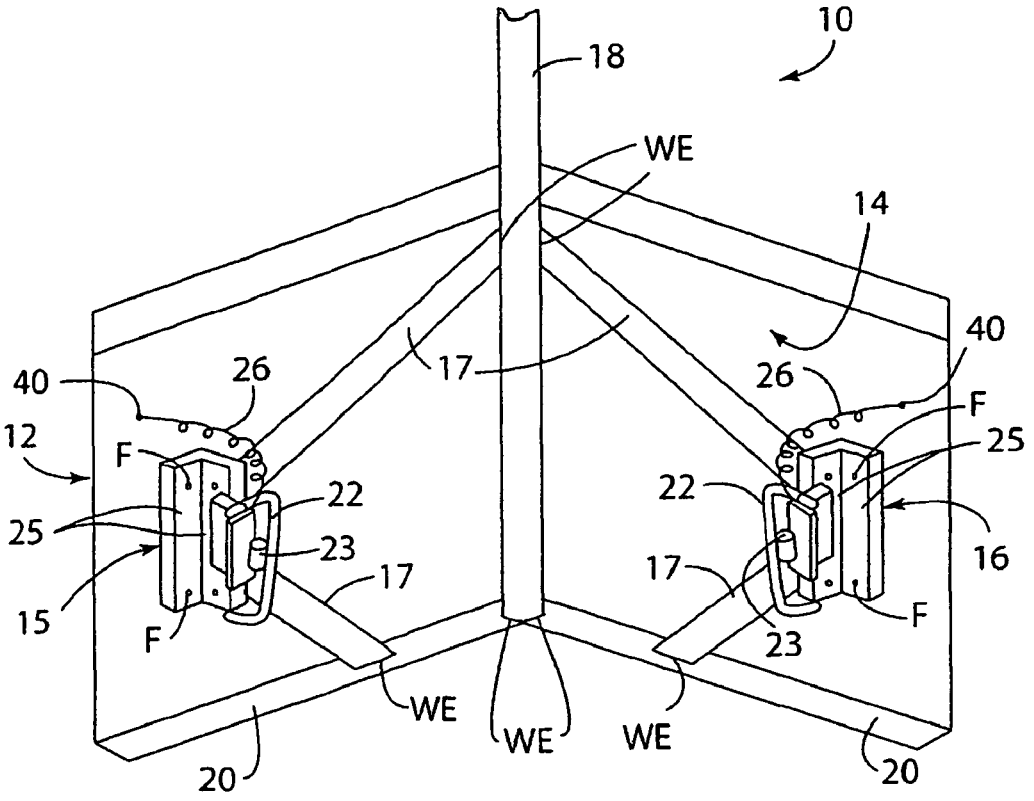
FIG. 2 is a rear view of an embodiment of the snowplow and mounting assembly.
Figure 3:
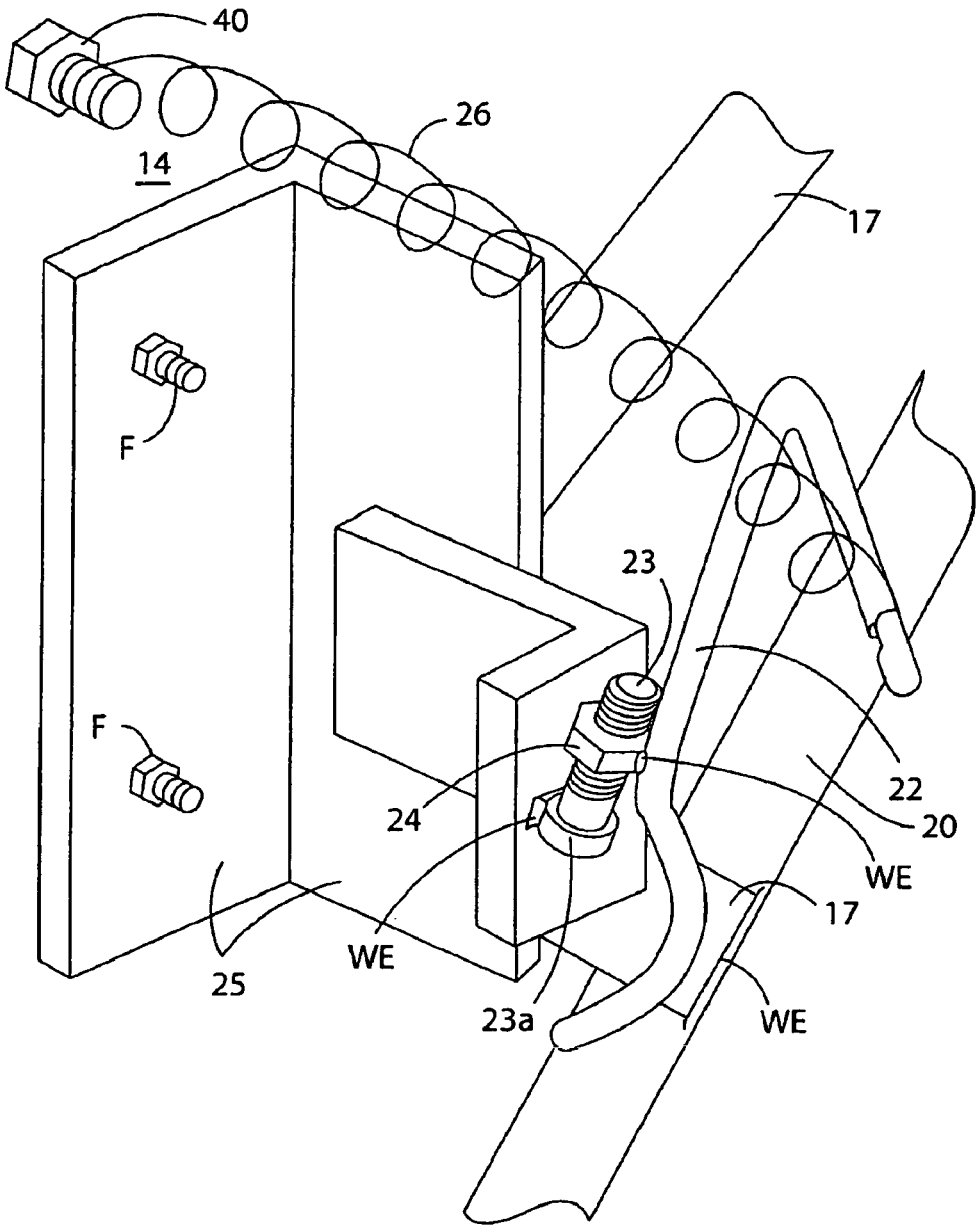
FIG. 3 is an enlarged view of a linkage and respective locking element.
Figure 4:
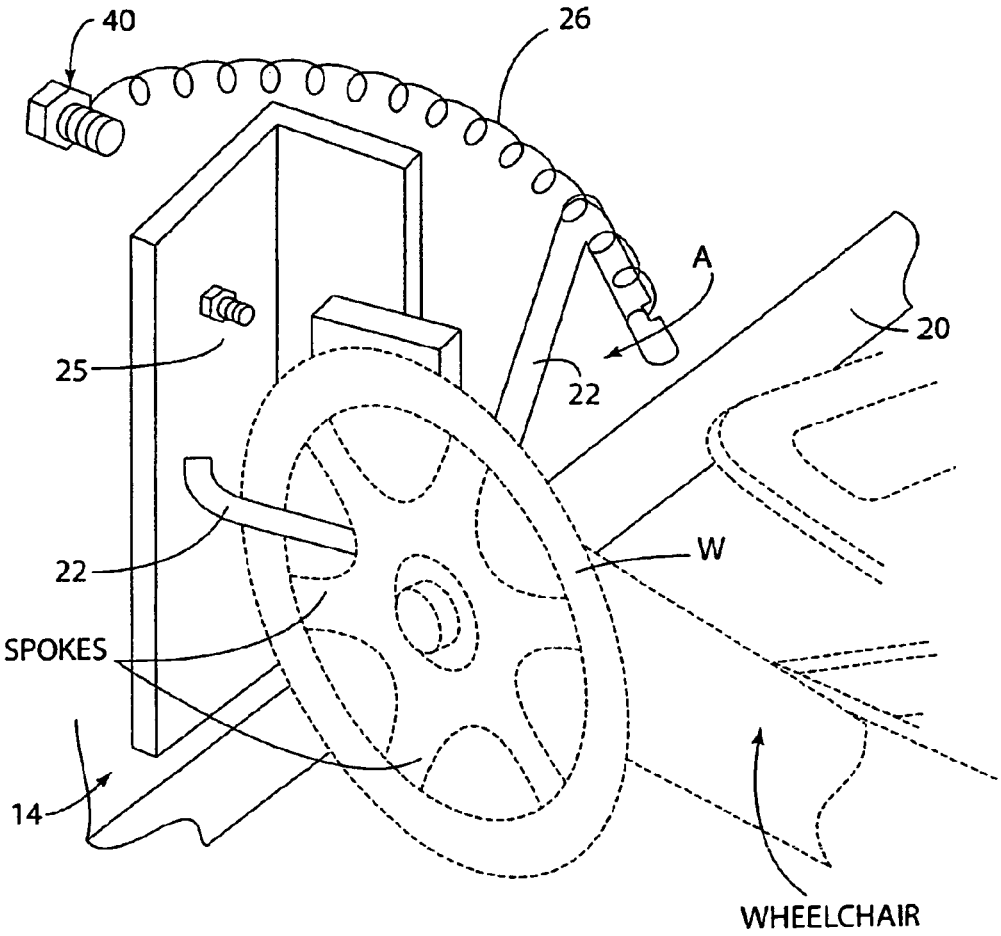
FIG. 4 is an enlarged view of a linkage engaged into the spoke of a wheel of a wheelchair.

The present invention provides a snowplow and mounting assembly having a mounting frame including one side with a V-shape or other shape snowplow thereon facing away from the wheelchair and including another side that faces the wheelchair and is adapted to cooperate with the wheelchair in use to plow snow. The snowplow and mounting assembly can cooperate with the wheelchair by being releasably engaged thereto and/or moved thereby. Referring to FIGS. 1-4, there is illustrated a preferred embodiment of the snowplow and mounting assembly 10. An illustrative embodiment of the snowplow and mounting assembly comprises a mounting frame 12 for releasable connection to a wheelchair. A snowplow blade 11 is disposed on the front side of the mounting frame 12. First and second pivotal linkages 15,16 are disposed on the back or rear side of the frame for releasably engaging and connecting to respective first and second wheels W of a wheelchair. At least one handle 18 is disposed on the frame and is adapted to be operated by user of the wheelchair.

Mounting frame 12 includes a frame member having a front upstanding side 13 and a back upstanding side 14 which make up the surface of a V-shaped snowplow and mount assembly 10. Mounting frame 12 typically is constructed from one or more metal, plastic, wood or any other sheet or plate materials of sufficient strength for plowing snow and can include one or more reinforcing corrugations (e.g. corrugation C) to this end. The front side 13 of the mounting frame can include snowplow blade 11 and bottom plate edge 20 also can be provided for snow removal. Mounting frame 12 also can be reinforced by attaching crossbars 17 diagonally across the back side 14. Crossbars 17 can be attached by welding, bolting, or other means (e.g. welds WE) to at or near handle 18, and at or near bracket 25 and to the bottom plate edge 20 adjacent the back side of the mounting frame. Handle 18 is attached at its lower end by welding or fasteners to the bottom edge plates 20, completing the reinforced mounting frame. The back side 14 of the mounting frame 12 can include first and second pivotal linkages 15, 16 for releasably securing snowplow and mounting assembly 10 to a wheelchair.

Snowplow blade 11 can be disposed on the front side 13 of the mounting frame 12. Snowplow blade 11 can be constructed of metal, plastic, wood, or any other material of suitable strength for plowing snow. Further, the one or more bottom plate edges 20 can extend beyond the front side of the mounting frame 12. Each bottom plate edge 20 can be disposed on the bottom of the snowplow and mount assembly and can extend past the front of the mounting frame 12 where they each include a sharpened blade 21. When the wheelchair and snowplow are in use, bottom edges 20 and sharpened blades 21 can cut under snow and allow for easier removal of snow. And in times when there is no snow, the blades can be used for cutting weeds or grass.

First and second pivotal linkages 15, 16, can be disposed on the back side 14 of the mounting frame 12. First and second linkages 15, 16 can be constructed from metal, plastic, or other means and attachment to mounting frame 12 can be achieved by weld, bolt, or other means. Each linkage can include a linkage arm 22, a fixed pivot shaft 23, a pivot-shaft receiving member 24, and a bracket assembly 25 fastened to the back side of the frame by fasteners F. Though a linkage and its respective elements are described below in the singular, it should be apparent to those skilled in the art that such description is true for both first and second pivotal linkages 15, 16. Bracket assembly 25 is employed to attach a linkage to the back side 14 of the mounting frame 12. Fixed pivot shaft 23 is attached to bracket assembly 25 and can comprise a threaded bolt, for example, having a base region 23*a* welded on the bracket assembly so that the pivot shaft 23 (e.g. threaded bolt) is upright and spaced from the bracket assembly to provide a space there between that allows the pivot-shaft receiving member 24 (e.g. threaded nut) to rotate thereon. Linkage arm 22 is attached (e.g. welded) to the corresponding pivot-shaft receiving member 24 (e.g. threaded nut), which is disposed on and can pivot or rotate on a respective pivot shaft 23 by rotation on threads. Further, linkage arm 22 can be constructed from metal, plastic, or other material of suitable strength and can be formed such that the bottom end curves allowing it to lock into the spokes of first (left) and second (right) wheels of a wheelchair. The top end of linkage arm 22 can have a notch (shown), hole, etc., which can allow a locking element 26 to connect to the linkage arm. Locking element 26 can be disposed on the back side of the mounting assembly and can include a spring, or other biasing means. One end of locking element 26 can be connected by fastener 40 to the back side 14 of the mounting frame 12 and the other end can be connected to linkage arm 22. When the locking element is engaged, it keeps the linkage arm from disconnecting from the wheel of a wheelchair by biasing the linkage arm in the direction of arrow A. First and second linkages 15, 16, can be easily connected and disconnected to first and second wheels by the user while sitting in a wheelchair. The user need only drive up to the snowplow and pivot linkages 15 and 16 into the spokes of first and second wheels of a wheelchair. The connecting wheels can be the front wheels, commonly known as the tip wheels.

At least one handle 18 can be disposed on the back side of the snowplow and mount assembly 10 and attached (for example, welded) to the back side 14 of the mounting frame 12. Handle 18 can be constructed of metal, plastic, or other material, can include a rubber hand grip, and can be attached by weld, bolt, or other means. When the snowplow and mount assembly 10 is properly engaged and connected to a wheelchair the handle 18 can allow the user to lift and pivot the snowplow to avoid rocks and other obstacles. User can grip handle 18 and pull towards them to raise, or push away from them to lower, the snowplow.

Snowplow and mount assembly 10 can form an enclosure around the user thereby directing snow away from the user. This directing of snow can be achieved by constructing the snowplow and mount assembly 10 to be slightly wider than the wheelchair itself. Common wheelchairs range in overall width from about 20" to about 27", thus snowplow and mount assembly 10 can range from about 21" to about 30", for purposes of illustration and not limitation. Similarly, wheelchair drive wheels range from about 10" to about 16" in diameter, thus the snowplow and mount assembly 10 can range from about 13" to about 20" in height, for purposes of illustration and not limitation.

Figure 5:
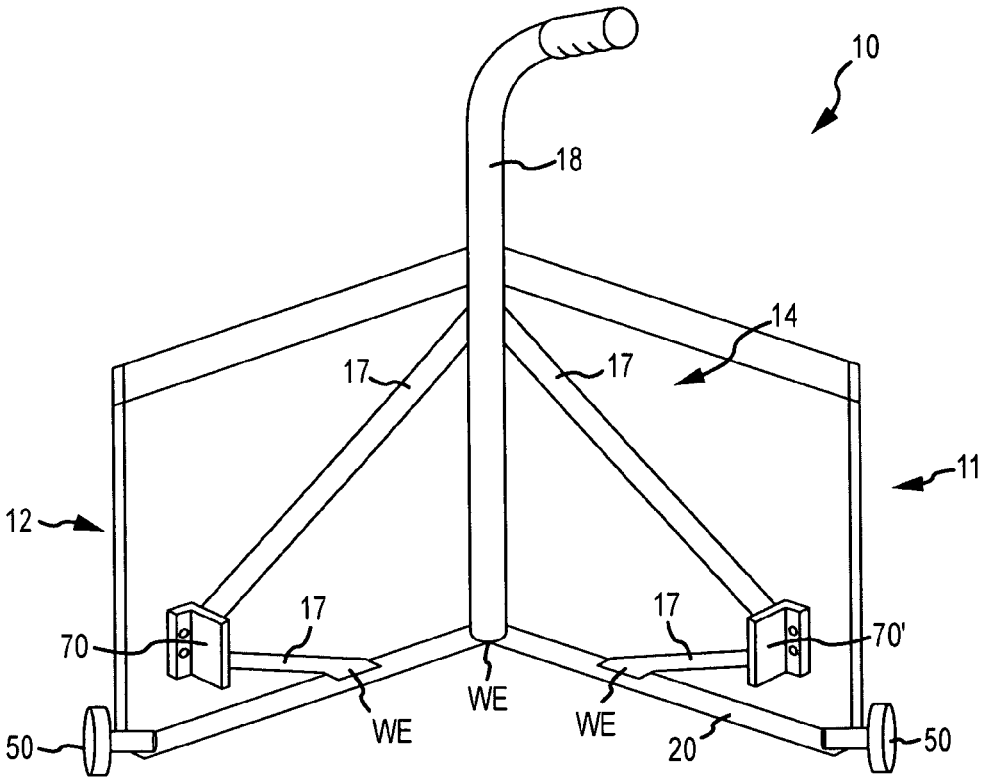
FIG. 5 is a rear view of an alternative embodiment of the snowplow and mounting assembly.
Figure 7:
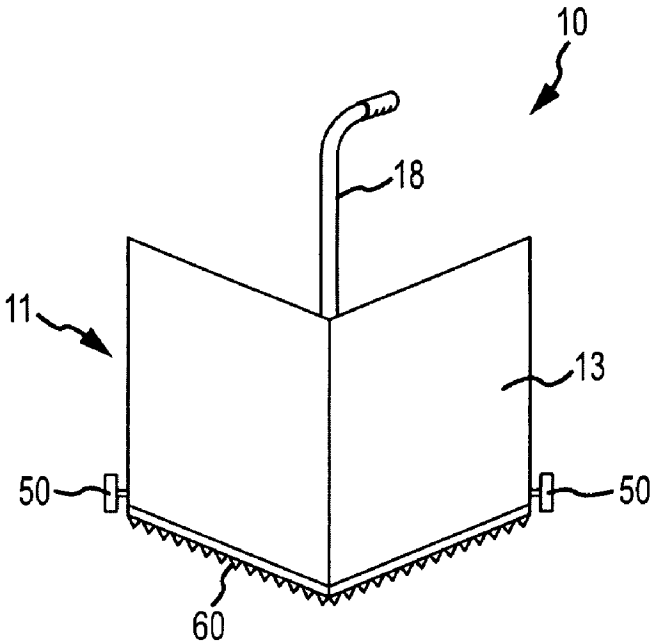
FIG. 7 is a front view of the alternative embodiment of the snowplow and mounting assembly seen in FIG. 6.
Figure 6:
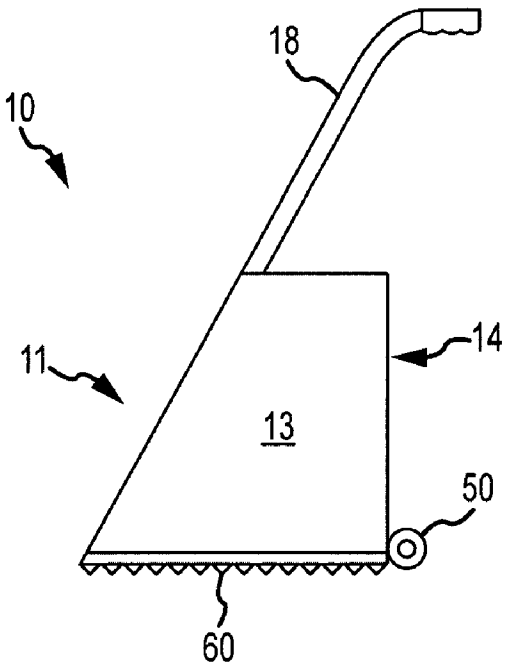
FIG. 6 is a side view of the alternative embodiment of the snowplow and mounting assembly seen in FIG. 5.

Attention is now invited to FIGS. 5-7, showing an alternative embodiment of the plow and mounting assembly apparatus 10. This alternative embodiment is similar to the embodiment just described, except that there is not a direct connection between the wheelchair and the plow and mounting assembly. Rather, the two tip wheels on a motorized wheelchair engage and push against a pair of wheel push brackets disposed upon the plow and mounting assembly. The "tip wheels" on many conventional motorized wheelchairs are rotatably mounted at the front of the chair and project forward of the chair, but do not ordinarily engage the ground or floor while the chair is in motion. Rather, the wheels are elevated somewhat above the ground, and are devised to engage the ground only when the chair is tipped forward; thus they serve as stabilizing wheels to protect the chair against overturning forward. In the practice of this alternative embodiment of the invention, as the powered wheelchair moves controllably forward, the tip wheels pushably engage against the push brackets, to impart corresponding forward motion to the mounting assembly and plow.

This alternative embodiment of the snowplow and mounting assembly features a mounting frame 12 for pushing engagement or contact with the motorized wheelchair. The snowplow blade 11 is disposed on the front side of the mounting frame 12. First and second wheel push brackets 70, 70' are disposed on the back or rear side of the frame 12 for engaging against and being pushed by respective first and second tip wheels 69 (FIGS. 8 and 9A-B) of a motorized wheelchair 65. A handle 18 is disposed on the frame and is adapted to be operated by the user of the wheelchair.

Figure 9A:
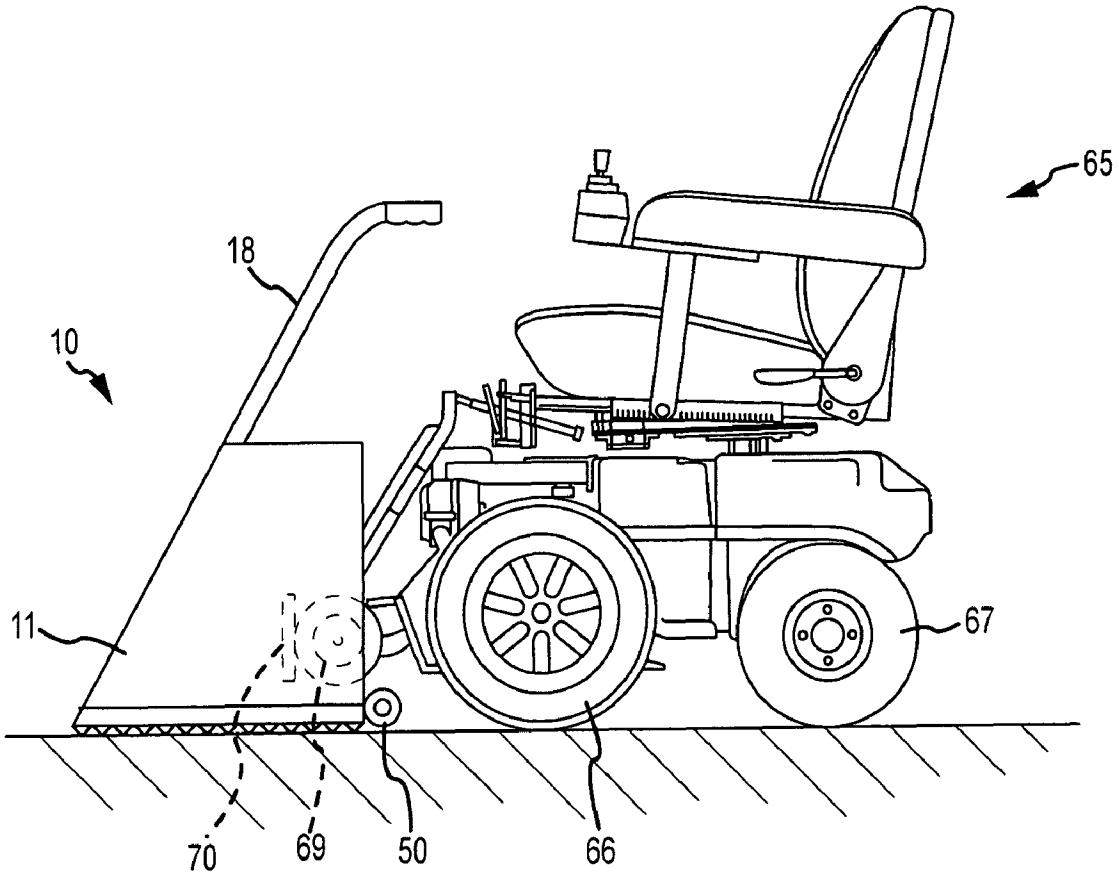
FIG. 9A is a side view of the alternative embodiment of the snowplow and mounting assembly, shown in cooperative relation with a motorized wheelchair, the plow in the use position.

As seen in FIGS. 5-7, mounting frame 12 includes a frame member having a front upstanding side 13 and a back upstanding side 14 which make up the surface of the V-shaped snowplow and mount assembly 10. It is understood that while the plow and mount assembly 10 preferably has a V-shape when viewed from above, as is conventional with snowplows, the side-view profile of the plow blade 11 seen in FIG. 6 is exemplary only. The plow blade 11 can be shaped in various profiles and contours, as may be suited to style or function. Mounting frame 12 typically is constructed from one or more metals or plastics, or other suitable materials, as previously mentioned herein. The front side 13 of the mounting frame includes the snowplow blade 11 and bottom plate edge 20 also can be provided for snow removal. Mounting frame 12 also can be reinforced by attaching crossbars 17 diagonally across the back side 14, as seen in FIG. 5. Crossbars 17 can be attached by welding, bolting, or other means (e.g. welds WE) to the assembly at or near handle 18, and at or near push brackets 70, 70', and to the bottom plate edge 20 adjacent the back side of the mounting frame. It is understood that bracing and framing are optional as separate components joined to the blade by welding or the like. In other embodiments of the apparatus, the blade and frame can be integral, such as by corrugating the blade 11 and/or by bending the blade to be self-reinforced as with integral flanges along top, side, or bottom edges to lend overall structural stability to the blade. Handle 18 is attached at its lower end by welding or fasteners to the bottom edge plates 20, completing the reinforced mounting frame. The back side 14 of the mounting frame 12 (or blade 11) mounts the first and second push brackets 70, 70' against which the tip wheels 69 push to move the snowplow and mounting assembly 10 forward under the force of the motorized wheelchair 65 (FIG. 9A).

Continuing reference is made to FIGS. 5-7, showing that the plow and mount assembly 10 preferably is provided with blade wheels 50 on either side end of the blade 11. The blade wheels 50 are rotatably mounted upon axles, the axles being well-secured to the mount assembly 10 proximate to the two outer bottom corners of the blade 11. The wheels 50 are adapted to engage and wheel along the surface of the ground when the apparatus 10 is in active use. Thus, the blade wheels 50 preferably rotate about horizontal axes that are perpendicular to the direction of travel.

Combined reference to FIGS. 6 and 7 shows that the bottom front edge of the blade 11 optionally may be serrated, or provided with a serrated fixture or member 60 fixed thereon. In times when there is no snow, the blade 11 accordingly can be used for cutting weeds or grass, as the serrations or serrated member 60 on the front bottom edge of the blade 11 sever at ground level any weeds encountered by the forward-moving blade during operation of the apparatus 10.

Figure 8:
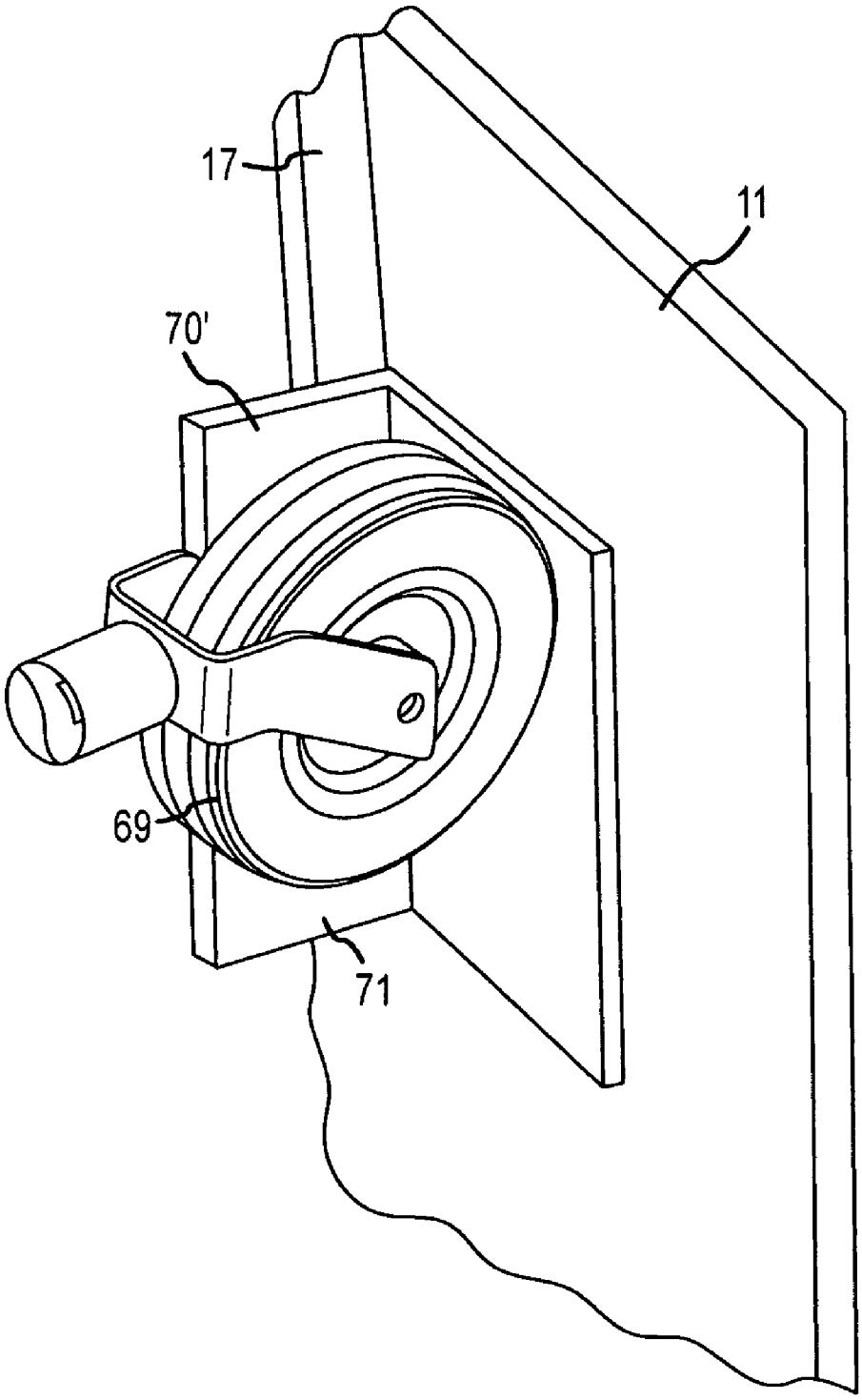
FIG. 8 is an enlarged partial view of the alternative embodiment of the snowplow and mounting assembly seen in FIG. 5, showing a tip wheel of a wheelchair in engaged pushing position with a wheel push bracket, the plow shown in partial section and the remainder of the wheelchair omitted from view.

Combined reference is made to FIGS. 5 and 8. FIG. 8 shows a single one (e.g., a right side) of the wheel push brackets 70', the pair of which are seen in FIG. 5. It is understood that description of either bracket 70 or 70' serves to describe both. The wheel push brackets 70 and 70' are mounted on the back or rear side of the plow and mounting frame (on a frame or on the backside of the blade itself) as by welding or bolting or the like. As depicted, the brackets are elongated and L-shaped (in cross section), with the back flange of each bracket facing inwardly on the mounting frame 12. The brackets 70, 70' are mounted proximate to the laterally outward side edges of the plow blade 11 but, as suggested in FIG. 5, are offset inwardly toward the centerline of the assembly a certain amount.

As seen in the drawing figures, the brackets 70, 70' are situated a modest distance above the bottom edge of the blade 11. However, it is to be readily understood that the brackets 70, 70' can be located at any practical elevation on the back of the assembly 10 to correspond to the height elevation of the tip wheels of a wheelchair. The wheel push brackets 70, 70' are located so as to correspond in position with the tip wheels 69 of a motorized wheelchair 65, when a wheelchair is immediately in back of the snowplow and mount assembly 10, as seen in FIG. 9A. Thus, the elevation of the brackets 70, 70' above ground (and from the bottom edge of the blade 11) approximates the distance between the ground surface and the axles of a wheelchair's tip wheels 69 when the mount assembly 10 is upon the ground as seen in FIG. 9A. In some embodiments and applications, the wheel push brackets 70, 70' may be situated very near or immediately above the bottom edge of the blade 11. Further, the separation distance between the wheel push brackets 70, 70' corresponds generally to the separation distance between the two tip wheels 69 on the wheelchair.

Referring to FIG. 8, it is seen that the purpose of the push brackets 70, 70' is to serve as a bearing surface against which the tipper wheels 69 of the motorized wheelchair push during operation of the apparatus. It is seen that each of the brackets 70, 70' very preferably has at least one flange portion 71 that extends rearward (e.g., approximately perpendicularly, or parallel to the plane of rotation of the tipper wheel 69) from the blade 11. Each push bracket 70, 70' preferably is positioned such that each respective flange portion 71 is disposed just inside (laterally) from the corresponding tipper wheel 69. The flange portions are thus between the tipper wheels when the apparatus 10 is in use in front of a wheelchair. By this configured arrangement, the push brackets 70, 70' serve to hold the snowplow and mounting assembly 10 in proper alignment directly in front of the wheelchair 65 during use; the flange portions 71 contact the tip wheels 69 to prevent the snowplow and mounting assembly from shifting laterally (side-to-side, in relation to the wheelchair) while the snowplow and mounting assembly is being pushed forward during operation. The push brackets 70, 70' also serve to provide a bearing surface against which the tip wheels press during the practice of the invention. (It is observed that the tip wheels 69 are rotatable upon their axes, but ordinarily do not rotate, and do not rotate when in contact with the push brackets 70, 70'; their primary function is to prevent the motorized wheelchair from tipping over forwards, according to conventions known in the art.)

Also, one skilled in the art recognizes immediately that the wheel push brackets 70, 70' may feature or define any of a wide variety of shapes, including cross-sectional shapes and contours, besides the L-shape depicted in the drawing figures. By way of further example, the brackets 70,70' may be U-shaped in cross-section ("C brackets"), with the "U" opening rearward away from the blade 11, in which example each tip wheel 69 may be inserted into the throat of the "U" (between two flange portions) of the corresponding push bracket during use. Or the brackets 70, 70' may define a V-shape that opens rearward. Further, the lateral positions of the L-shaped brackets depicted in the drawing figures may be reversed, such that the respective flange portions 71 are each situate on the outside (rather than inside) of each tip wheel 69 during use. Any suitable shape, contour, or configuration may be utilized in the configuration of the brackets 70, 70', provided only that: (1) they supply bearing surfaces against which the pair of tip wheels 69 may push during use, and (2) that they engage the tip wheels in a manner which keeps the snowplow and mounting assembly 10 in registration with the wheelchair in the direction of forward travel during use, preventing the assembly 10 from "drifting" or shifting laterally to either side but rather guiding the assembly forward along the direction of travel.

It may be desirable optionally to deploy one or more elastic cords, of suitable lengths, between the apparatus 10 and the wheelchair 65 to assist in fastening the assembly to the chair (especially while backing up). For example, hooks or eyes (not shown) may be defined or provided on the rear of the assembly 10 (e.g., on or near the push brackets 70, 70') to which an end of a BUNGEE cord or other similar type of elastic cord may be releasably hooked or fastened. The opposite ends of the elastic cords are detachably connected (as with a hook) to a suitable part of the wheelchair 65. The elastic cords, so detachably installed under modest elastic tension, may assist in maintaining the proper position of the assembly 10 in front of the wheelchair 65.

Figure 9B:
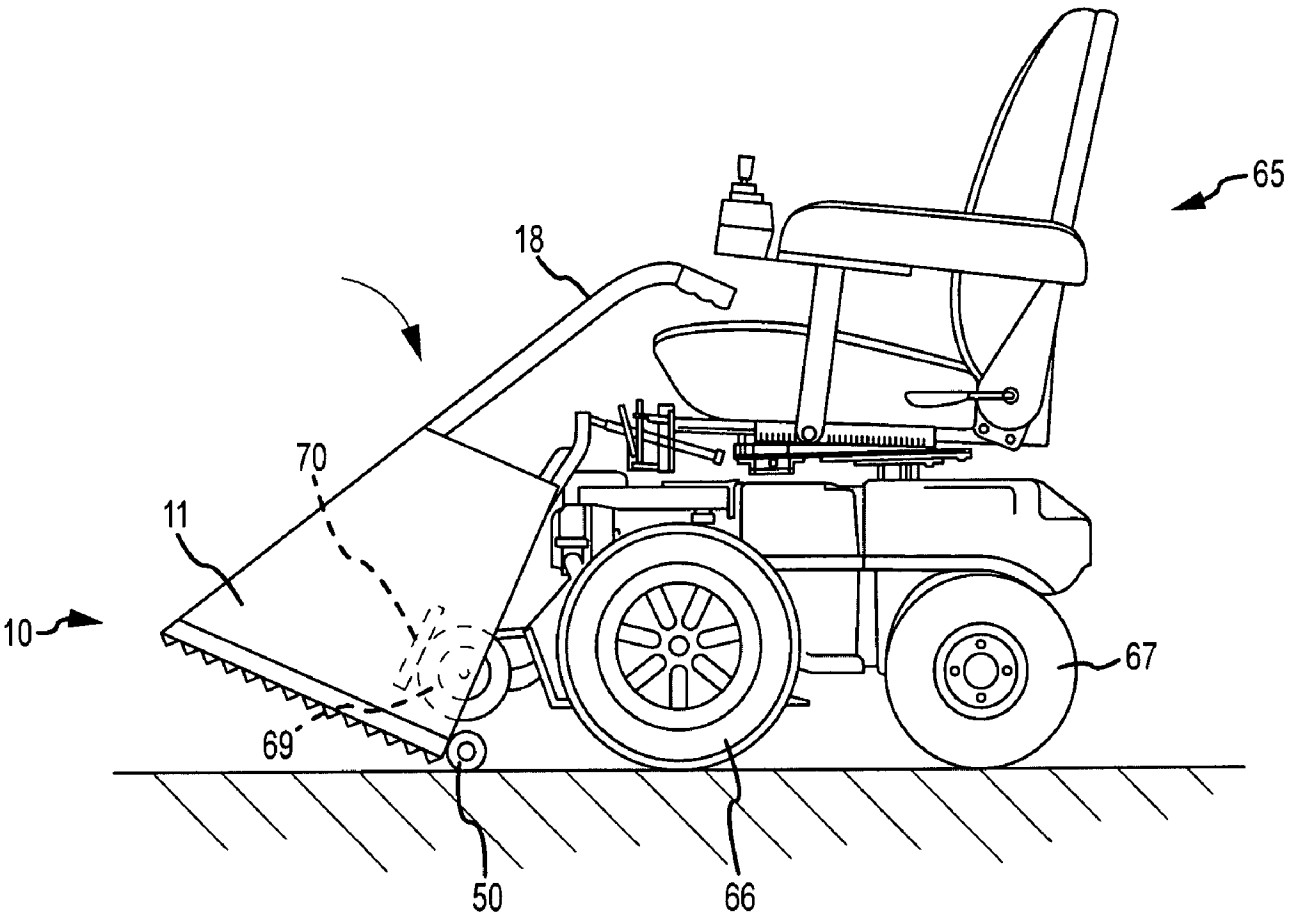
FIG. 9B is a side view of the alternative embodiment of the snowplow and mounting assembly, shown in cooperative relation with a motorized wheelchair, the plow in a lifted position.

The use of the snowplow and mounting assembly 10 is suggested by FIGS. 9A and 9B. The assembly 10 is placed upon the ground, with the bottom edge of the blade 11 proximate to the ground. A motorized wheelchair 65 is powered for controlled movement, by the driving action of the power wheels 66, and stabilized by the rear wheels 67. The wheelchair 65 is moved into position behind the assembly 10, and the two tipper wheels 69 (shown in phantom in FIGS. 9A and 9B) are brought into pressed engagement against corresponding ones of the pair of wheel push brackets 70, 70' (also shown in phantom in FIGS. 9A and 9B). The user grasps the handle 18 to help direct the assembly 10; the user powers the wheelchair 65 forward, pushing the assembly 10 in front of it as it moves along. The motion of the assembly 10, of course, causes the blade 11 to plow the snow from in front of the wheelchair 65. The blade wheels 50 support at least in part) the blade along the ground.

FIG. 9B illustrates how the assembly 10 is adapted for, and can be, rotatably lifted, as needed or desired, to manage and manipulate the action and position of the plow blade 11. When it is desired to lift the bottom edge of the blade 11 free and clear of the ground's surface, for example to permit the blade to pass above a low obstacle on the ground or to ease a comparatively abrupt change in the direction of travel (including to back up), the assembly can be rotated in a vertical plane. The user simply presses downward on the handle 18 and the assembly 10 rotates as indicated by the directional arrow in FIG. 9B. Such rotating/lifting movement of the snowplow and mounting assembly 10 is facilitated by the blade wheels 50, about which the assembly 10 pivots with the wheels 50 engaged with the ground. Further, as suggested by FIG. 9B, the tip wheels 69 remain free to rotate about their axes; so if the tip wheels happen to remain in contact with the push brackets 70, 70', the assembly can and will rotate with the tip wheels about their axes. The presence of the blade wheels 50 thus promotes easy manipulation of the blade 11 in the manner indicated.

The user operator thus can operate the apparatus 10 in cooperation with a motorized wheelchair 65 to plow sidewalks and the like. By allowing the wheelchair 65 (as driven by wheels 66) to pushably engage against the snowplow and mounting assembly 10, as the tip wheels 69 are pressed against the wheel push brackets 70, 70', the operator can steerably guide the assembly in front of the wheelchair to accomplish the plowing task.

Those skilled in the art will readily recognize numerous adaptations and modifications which can be made to the present invention which will result in an improved snowplow and mount assembly, yet all of which will fall within the spirit and scope of the present invention as defined in the following claims. Accordingly, the invention is to be limited only by the scope of the following claims and their equivalents.

The invention claimed is:

1. A combination of a motorized wheelchair and plow assembly movable across a surface by the driving action of wheelchair power wheels against the surface, comprising:

a wheelchair having:

power wheels;

first and second tip wheels, in front of the power wheels, rotatably mounted an elevation distance above the surface wherein said tip wheels do not engage the surface when the wheelchair is moving across the surface; and a plow assembly comprising:

a blade for pushing snow or debris toward a side of the wheelchair;

a handle operatively connected to the blade;

first and second wheel push brackets disposed at a back side of the blade at approximately the elevation distance above the surface, each push bracket contactable against a respective one of the first and second tip wheels, wherein when the push brackets are in contact with the tip wheels, movement of the wheelchair is imparted to the plow assembly by the tip wheels via the push brackets; and first and second blade wheels contactable with the surface and rotatably mounted proximate to outer bottom corners of the blade;

wherein while the wheel push brackets are in pressed contact with the tip wheels the power wheels remain against the surface, and the blade may be rotated, by a force applied to the handle, to lift a bottom edge of the blade from the surface by pivoting the push brackets and tip wheels around axes of the tip wheels.

2. A combination according to claim 1 wherein each of the push brackets has at least one flange portion extending rearward from the blade, such that each respective flange portion is disposed laterally adjacent to a corresponding tip wheel, whereby the flange portions are situated between the tip wheels when the assembly is in use in front of the wheelchair.

3. A combination according to claim 1 wherein the blade defines a serrated bottom edge.

4. A combination according to claim 1 further comprising a serrated member affixed to a bottom edge of the blade.

5. A combination according to claim 1 wherein:

each of the push brackets has at least one flange portion extending rearward from the blade, such that each respective flange portion is disposed laterally adjacent to a corresponding tip wheel; and the flange portions are situated between the tip wheels when the plow assembly is in front of the wheelchair, whereby the flange portions contact the tip wheels to prevent the plow assembly from shifting laterally thereby to hold the plow assembly in alignment directly in front of the wheelchair during movement of the wheelchair across the surface.

* * * * *